United States Patent [19]

Vassiliou

[11] Patent Number: 4,698,110

[45] Date of Patent: Oct. 6, 1987

[54] PREPARATION OF FLUOROPOLYMER COATED MATERIAL

[75] Inventor: Eustathios Vassiliou, Newark, Del.

[73] Assignee: E. I. Du Pont de Nemours and Company, Wilmington, Del.

[21] Appl. No.: 802,229

[22] Filed: Nov. 27, 1985

[51] Int. Cl.[4] ..... B29B 1/16; B32B 27/00; D02G 3/00

[52] U.S. Cl. ..... 156/231; 156/235; 156/246; 264/331.14; 427/394

[58] Field of Search ..... 428/245, 246, 249, 224; 427/100, 394, 395, 407.1, 412; 156/230, 239, 249, 247, 231, 238, 240, 242, 333, 235, 289, 298; 264/300, 331.14

[56] References Cited

U.S. PATENT DOCUMENTS

| | | | |
|---|---|---|---|
| 3,265,556 | 8/1966 | Hungerford et al. . | |
| 3,360,396 | 12/1967 | Kennedy et al. . | |
| 3,934,066 | 1/1976 | Murch | 428/249 |
| 4,024,679 | 5/1977 | Rain et al. | 428/246 |
| 4,054,710 | 10/1977 | Botsolas | 428/246 |
| 4,165,404 | 8/1979 | Quehl | 156/333 |
| 4,219,376 | 8/1980 | Roman | 428/246 |
| 4,327,153 | 4/1982 | Micherou | 427/100 |
| 4,442,162 | 4/1984 | Kuester | 427/412 |
| 4,612,074 | 9/1986 | Smith et al. | 156/231 |

FOREIGN PATENT DOCUMENTS

| | | |
|---|---|---|
| 1076015 | 3/1975 | Canada . |

*Primary Examiner*—Donald E. Czaja
*Assistant Examiner*—Louis Falasco
*Attorney, Agent, or Firm*—Richard H. Burgess

[57] ABSTRACT

A process for coating polyvinyl fluoride layers on one or both sides of a textile material in the form of a coalesced gel which is subsequently cured by heating.

7 Claims, 2 Drawing Figures

15
16
20
17
36
21
10
19
23
27
33
29
11
25
32
37
18
13
34
28
24
30
31
22
26
12
35
14

41
43
42

PREPARATION OF FLUOROPOLYMER COATED MATERIAL

BACKGROUND

This invention relates to a process for the preparation of a laminate of a textile substrate and an integral polyvinyl fluoride film layer on at least one surface of the substrate.

A process for making an integral polyvinyl fluoride film was discussed in U.S. Pat. No. 2,953,818 which issued to L. R. Barron on Sept. 27, 1960. This patent claims a process for producing polyvinyl fluoride film from a mixture of finely-divided polyvinyl fluoride particles and a latent solvent for the particles. The solvent is removed to produce a gel which is then cured. The produced film structures are self-supporting and capable of being oriented.

Polyvinyl fluoride films have been used for many years by printed circuit board manufacturers as a release agent in the manufacture of epoxy and phenolic printed circuit boards. Production rates of such circuit boards were increased by use of these films because of the films' high-temperature tolerance and non-stick properties. Since the desirable release-agent properties are imparted by the fluoropolymer surface, it would be advantageous if there could be provided a tough, durable, relatively low cost carrier for the fluoropolymer surface that would impart improved handling properties beyond those of self-supporting polyvinyl fluoride film.

Known bonding of such polyvinyl fluoride film to a textile substrate as in U.S. Pat. No. 3,265,556 which issued to Hungerford et al. on Aug. 9, 1966 is not practical from an economic viewpoint, since polyvinyl fluoride film is not commercially available in web thicknesses of less than about 0.5 mil. The manufactured cost of such a laminate would, therefore, be too high. Also, the commercially available polyvinyl fluoride film is oriented which results in a film that is too stiff, has low tear strength and is prone to shrink when subjected to heat.

U.S. Pat. No. 3,360,396, which issued to Kennedy et al. on Dec. 27, 1967, discloses a substrate coating process wherein a polyvinyl fluoride-latent solvent dispersion is applied onto the surface of the substrate to give a wet coating thickness of up to about 30 mils thickness and subsequently heated to effect adhesion of the coating to the substrate. The casting of such a solvent solution of the polyvinyl fluoride polymer onto a textile substrate with the subsequent removal of the solvent does not provide a practical method for making a coated textile product. This is because polyvinyl fluoride is insoluble in commonly used volatile solvents such as acetone, petroleum ether, isooctane, xylene, carbon tetrachloride, chloroform, methanol, ethanol, etc., and polyvinyl fluorides of high inherent viscosity (high molecular weight), which are preferred for film manufacture, are less soluble even in hot solvents such as hot dimethylformamide, tetramethylene sulfone, nitroparaffins, cyclohexanone, dibutyl ketone, mesityl oxide, aniline, phenol, methyl benzoate, phenyl acetate and diethyl phosphate than are the polyvinyl fluorides of lower inherent viscosity. While the use of hot solutions to accomplish solvent casting techniques is possible, it presents serious equipment and safety problems. Such a process also produces a coated textile substrate that is quite thick and stiff. In fact, such a laminate is too thick and stiff for use as a release film in the manufacture of printed circuit boards.

Canadian Pat. No. 1,076,015, which issued on Nov. 4, 1974, describes a process for coating a plastisol (with plasticizer) of polyvinyl chloride or a copolymer of vinyl chloride with vinyl acetate as a cohesive gel onto a fabric and then curing the resulting laminate. Apparently, such processes have not been used with polyvinyl fluoride. Polyvinyl chloride is much less costly than polyvinyl fluoride, so that a greater degree of impregnation of a textile substrate by the gelled coating can be tolerated with polyvinyl chloride. It could be anticipated that too much polyvinyl fluoride would impregnate such a substrate for economical results, especially since polyvinyl fluoride is used without plasticizers.

This invention provides a practical method for preparing a coated textile substrate having a thin integral coating of polyvinyl fluoride polymer on at least one surface of the substrate. It has been found that quite thin layers of polyvinyl fluoride can be made to stay on the surface of a textile substrate.

SUMMARY OF THE INVENTION

The present invention provides a process for laminating a textile material with a polyvinyl fluoride film comprising:

preparing a polyvinyl fluoride dispersion from a polyvinyl fluoride resin and a latent solvent so as to have a solids content of from 5 to 50% by weight, coating a heated belt surface with said polyvinyl fluoride dispersion to a thickness that will give a dried film thickness not exceeding 25 μm while maintaining the belt surface temperature adequate to heat the dispersion to a temperature high enough to gel the dispersion but below the fusion temperature of the resin, forming a gelled, coalesced polyvinyl fluoride film layer on the heated belt surface and maintaining contact with the heated belt surface long enough to remove enough of the latent solvent to coalesce the polyvinyl fluoride layer to form a cohesive gel, passing the textile material adjacent to the cohesive gel so that the cohesive gel adheres to the textile material, and passing the textile material with the adhered cohesive gel into a nip point so as to form a laminate of the textile material with the adhered cohesive gel and heating said laminate to temperatures high enough to fuse said polyvinyl fluoride film layer, generally at least 195° C., preferable above 210° C.

Depending on the nature and residual amounts of the latent solvents, generally under 40% by weight based on the resin plus solvent, preferably 1 to 10%, the belt temperature should be in the range of 170° to 210° C. to give a gel temperature of 110° to 195° C., preferably 150° to 195° C., more preferably 170° to 195° C.

Two-sided coating processes and coated products are also aspects of the invention.

DETAILED DESCRIPTION

The word "laminate" herein does not refer to a structure made by adhering multiple films together but rather is used to refer to the product of a process of putting a gelled coating on a porous surface and fusing with minimum impregnation. The interface of the two layers behaves as a composite of the two materials.

Figure 1:
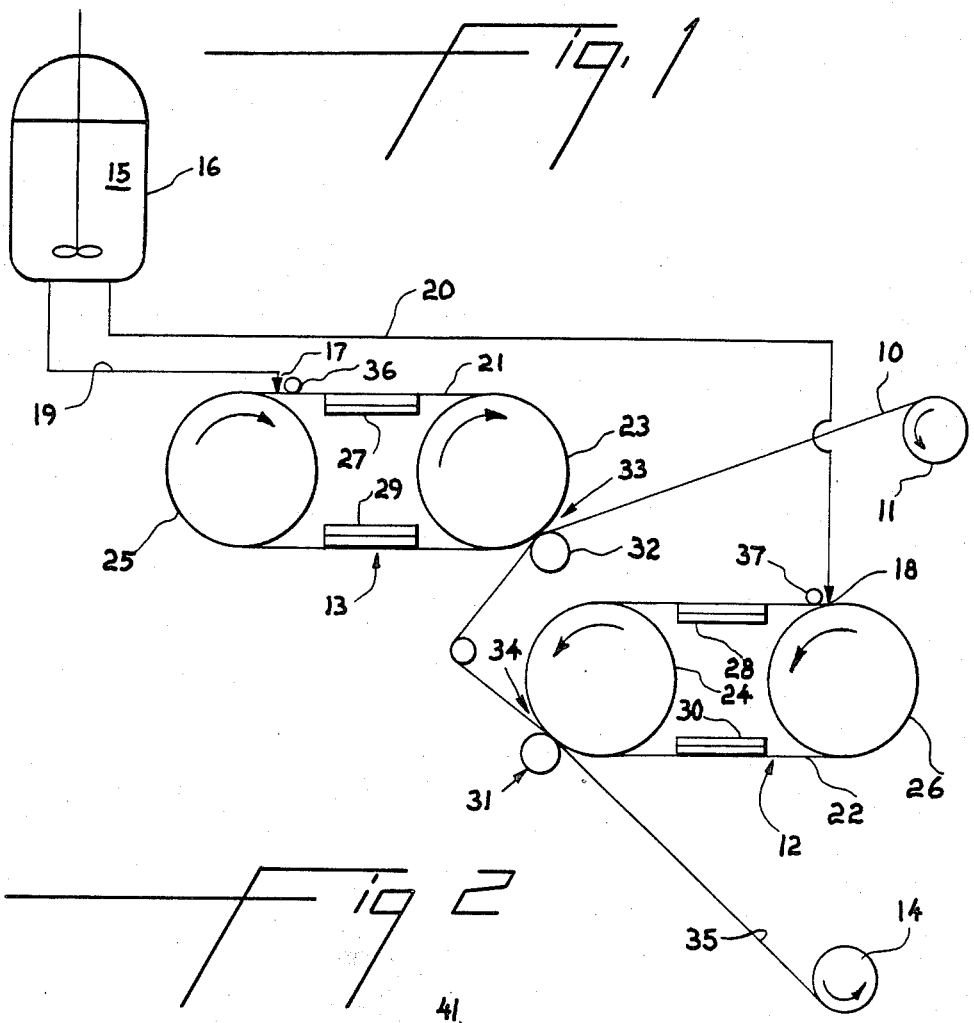
FIG. 1 is a schematic drawing depicting the process of the present invention.

Referring to FIG. 1, the textile material 10 to be coated is unwound from unwind stand 11, through the processing sections 12 and 13 and onto a windup position 14. The material used for coating the textile material 10 is a PVF dispersion 15 of polyvinyl fluoride powder in a latent solvent, as herein defined. The PVF dispersion is prepared in agitated vessel 16 and pumped to hoppers 17 and 18 via transfer lines 19 and 20.

The hoppers 17 and 18 distribute the PVF dispersion across casting belts 21 and 22 and wire-round rods 36 and 37 uniformly apply a wet-film PVF dispersion coating of 25 μm thickness or less across the casting belts 21 and 22. Casting belts 21 and 22 are driven by heated rolls 23 and 24 and chilled rolls 25 and 26. Auxiliary heating may be provided by preheater plates 27 and 28 and auxiliary cooling may be provided by cooling plates 29 and 30.

The casting belts preferably have surfaces that are covered with polytetrafluoroethylene to enhance the formed-film release characteristics. The casting belts are heated by the heated rolls and, optionally, the preheater plates to maintain a belt surface temperature of about 170° to 210° C. The residence time of the cast dispersion on the belts is usually from 0.5 to 10 seconds depending on the cast wet film thickness and the quantity and type of latent solvent employed. During this residence time, the cast PVF dispersion coalesces into a gel-like polyvinyl fluoride film having a low latent solvent content. The casting belts 21 and 22 are in engagement with nip rolls 31 and 32. When the gel-like coalesced polyvinyl fluoride film on the surfaces of casting belts 21 and 22 reach the nip points 33 and 34, contact is made with the textile material 10 and a laminate 35 of the polyvinyl fluoride film and textile substrate is formed with the adhesion between the two layers being provided solely by the substances of the two layers.

The polyvinyl fluoride-latent solvent dispersion can be prepared by blending the polyvinyl fluoride with latent solvent in a wide variety of mixing equipment, including ball mills, colloid mills and sand grinding equipment. The fluidity of the composition may vary greatly depending on the type of textile material on which the dispersion is to be applied. Generally, about 100 to 1000 parts, by weight, of latent solvent per 100 parts by weight of polyvinyl fluoride are suitable. The preferred range is 300 to 600 parts of latent solvent per 100 parts by weight of the polymer. The polyvinyl fluoride-latent solvent dispersion is applied to the surfaces of the casting belts 21 and 22 so as to produce a dry coating thickness at nip points 33 and 34 of about 2.5 to 75 μm.

In addition to the polyvinyl fluoride polymer employed in the practice of this invention, there also may be employed copolymers of vinyl fluoride with minor amounts of monoethylenically unsaturated monomers copolymerizable therewith which leave the properties essentially the same for purposes of the present invention.

The term "latent solvent" as used herein is defined as an organic liquid having a boiling point above IOO° C. (at atmospheric pressure), and having no significant solvent or swelling action on polyvinyl fluoride at room temperature, but being capable at an elevated temperature below its normal boiling point of solvent action sufficient to cause polyvinyl particles to coalesce.

The following are examples of specific compounds representative of the class of latent solvents useful in the process of the present invention:

Butadiene cyclic sulfone, tetramethylene sulfone, dimethylsulfolane, hexamethylenesulfone, diallylsulfoxide, dimethylsulfoxide, dicyanobutene, adiponitrile, ethylene carbonate, propylene carbonate, 1,2-butylene carbonate, 2,3-butylene carbonate, isobutylene carbonate, trimethylene carbonate, N,N-diethylformamide, N,N-dimethylacetamide, N,N-dimethylformamide, N,N-dimethyl-gamma-hydroxyacetamide, N,N-dimethyl-gamma-hydroxybutyramide, N,N-dimethylacetamide, N,N-dimethylmethoxyacetamide, N-methylacetamide, N-methylformamide, N,N-dimethylaniline, N,N-dimethylethanolamine, 2-piperidone, N-methyl-2-piperidone, N-methyl-2-pyrrolidone, N-ethyl-2-pyrrolidone, N-isopropyl-2-pyrrolidone, 5-methyl-2-pyrrolidone, beta-propiolactone, gamma-angelicalactone, delta-valerolactone, gamma-valerolactone, alpha-angelicalactone, beta-angelicalactone, epsilon-caprolactone, and alpha, beta and gamma-substituted alkyl derivatives of gamma-butyrolactone, gamma-valerolactone and delta-valerolactone, as well as delta-substituted alkyl derivatives of delta-valerolactone, tetramethyl urea, 1-nitropropane, 2-nitropropane, acetonyl acetone, acetophenone, acetyl acetone, cyclohexanone, diacetone alcohol, dibutyl ketone, isophorone, mesityl oxide, methylamyl ketone, 3-methylcyclohexanone, bis-(methoxymethyl)-uron, methylacetylsalicylate, diethyl phosphate, dimethyl phthalate, ethyl acetoacetate, methyl benzoate, methylene diacetate, methyl salicylate, phenyl acetate, triethyl phosphate, tris(morpholino) phosphine oxide, N-acetylmorpholine, N-acetylpiperidine, isoquinoline, quinoline, pyridine and tris(dimethylamido) phosphate.

Figure 2:
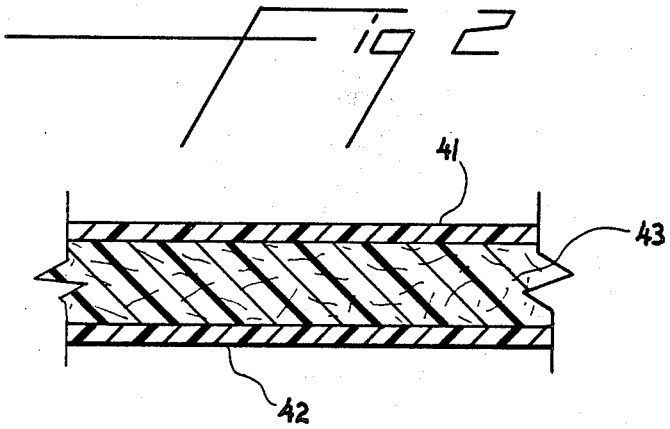
FIG. 2 is a fragmentary section of the coated laminates of the present invention as produced by the process depicted in FIG. 1.

In FIG. 2, the fabric substrate is shown at 43 and the polyvinyl fluoride coatings applied according to the invention are at 41 and 42.

The textile material employed in the practice of this invention is made of glass, cellulose or polymeric filaments in the form of monofilaments, continuous filament yarn or staple yarn. The polymeric material is preferably a polyester or a copolyester with polyethylene terephthalate being preferred; "Reemay" spunbonded polyester fabric made by Du Pont is preferred. The textile material can be formed by spun-bonding, knitting, or weaving using any of the noted filamentary materials. A preferred material is spun-bonded fabric made from polyethylene terephalate yarn.

The preference of the material will depend on the final intended application. For example, for release film to be used in the manufacture of printed circuit boards, the preferred substrate is a spunbonded polyester textile material having an overall thickness of 37 to 75 μm and weighing from 4 to 6 ounces per square yard. Another example of an end-use application is in greenhouses where the polyvinyl fluoride coated textile substrate is used as a glass replacement. In this example, the preferred substrate is a woven glass filamentary material. The preferred substrate for awning and canopy applications is a woven cellulosic textile material.

EXAMPLE

A polyvinyl fluoride dispersion was applied, by use of a #12 wire round rod, to two pieces of aluminum that were coated with polytetrafluoroethylene. The dispersion formulation, in parts by weight, was:

| | |
|---|---|
| Polyvinyl fluoride powder | 164.6 parts |
| Calcium carbonate | 9.8 parts |
| Silica | 9.8 parts |
| Surfactant (Zonyl A made by Du Pont) | 11.8 parts |
| Butyralactone | 416.5 parts |

The dispersion-coated aluminum pieces were then baked in an air oven at 177° C. for 12 minutes. The final dry coating thickness was 5 μm. A 3"×5" piece of spun-bonded polyester fabric having a unit weight of 4½ oz. per sq. yd. was used as a layer between the two coated aluminum pieces with the dispersion coated surfaces facing the spun-bonded fabric. This stack was then hot pressed at a 2000 psi pressure for 1 minute at 210° C. Two of the formed laminates of polyvinyl fluoride film/spunbonded polyester fabric/polyvinyl fluoride film were used as a release film for a 2.5"×3.0" piece of pre-preg at 175° C. at 300 psi for a 5-minute exposure time and a 1-hour exposure time. In both cases, the release properties were found to be as good as those of a pure film of polyvinyl fluoride.

We claim:

1. A process for laminating a textile material with a polyvinyl fluoride film not thicker than 13 μm comprising:

preparing a polyvinyl fluoride dispersion from a polyvinyl fluoride resin and a latent solvent so as to have a solids content of from 5 to 50%, by weight, coating a heated belt surface with said polyvinyl fluoride dispersion to a thickness that will give a dried film thickness not exceeding 13 μm while maintaining the belt surface temperature adequate to heat the dispersion to a temperature high enough to gel the dispersion but below the fusion temperature of the resin, forming a gelled, coalesced polyvinyl fluoride film layer on the heated belt surface and maintaining contact with the heated belt surface long enough to remove enough of the latent solvent to coalesce the polyvinyl fluoride layer to form a cohesive gel, passing the textile material adjacent to the cohesive gel so that the cohesive gel adheres to the textile material, and passing the textile material with the adhered cohesive gel into a nip point so as to form a laminate of the textile material with the adhered cohesive gel and heating said laminate to temperatures high enough to fuse said polyvinyl fluoride film layer.

2. The process of claim 1 in which the coalesced polyvinyl fluoride layers are applied to both sides of the textile material.

3. The process of claim 2 in which the dry film thickness of the polyvinyl fluoride on each side of the laminate does not exceed 13 μm.

4. The process of claim 1 wherein the belt is heated to a temperature in the range of 170° to 210° C.

5. The process of claim 1 wherein the film is fused at a temperature of at least 195° C.

6. The process of claim 1 wherein the gel is formed at a temperature in the range of 150° to 195° C.

7. The process of claim 6 wherein the film is fused at a temperature above 210° C.

* * * * *